US005896920A

United States Patent [19]

Jun

[11] Patent Number: 5,896,920

[45] Date of Patent: Apr. 27, 1999

[54] HEAT EXCHANGER FIN FOR AIR CONDITIONER

[75] Inventor: Hong-Seok Jun, Kyungki-do, Rep. of Korea

[73] Assignee: Samsung Electronics Co., Ltd., Suwon, Rep. of Korea

[21] Appl. No.: 08/991,661

[22] Filed: Dec. 16, 1997

[30] Foreign Application Priority Data

Dec. 30, 1996 [KR] Rep. of Korea ..... 96-77583

[51] Int. Cl.[6] ..... F28D 1/04

[52] U.S. Cl. ..... 165/146; 165/151; 165/181

[58] Field of Search ..... 165/146, 151, 165/181

[56] References Cited

U.S. PATENT DOCUMENTS 5,642,777 7/1997 Kang et al. ..... 165/146

FOREIGN PATENT DOCUMENTS

| | | | |
|---|---|---|---|
| 116094 | 5/1988 | Japan | 165/146 |
| 150589 | 6/1988 | Japan | 165/146 |
| 220092 | 9/1988 | Japan | 165/151 |
| 71096 | 3/1990 | Japan | 165/146 |

*Primary Examiner*—Leonard R. Leo

*Attorney, Agent, or Firm*—Burns, Doane, Swecker & Mathis, L.L.P.

[57] ABSTRACT

A heat exchanger fin includes a combination of a flat section, a wavy section, and a slit section arranged successively in a first direction, in order to compensate for different velocities of air passing across those sections, respectively, in a second direction transversely of the first direction, and thereby provide a uniform heat exchange rate across the fin.

12 Claims, 5 Drawing Sheets

HEAT EXCHANGER FIN FOR AIR CONDITIONER

BACKGROUND OF THE INVENTION

1. Field of the Invention

The present invention relates to a fin for a heat exchanger (e.g., an evaporator or a condenser) of an air conditioner.

2. Discussion of Related Art

As shown in FIG. 1, a conventional heat exchanger of an air-conditioner includes a plurality of parallel plates or fins 20 which are arranged between two end plates 10 at predetermined intervals, in order to cool air necessary for an air-cooling operation or in order to heat air for a heating operation when the air circulates. A plurality of heat transmission pipes 30 extend perpendicular to the end plates 10 and the fins 20, and are arranged in zigzag fashion. The pipes conduct refrigerant and transmit heat from the refrigerant to the fins 20. A plurality of return pipes 40 are connected to the ends of adjacent heat transmission pipes 30.

The fin 20 can be flat as shown in FIG. 2A, or wavy (FIG. 2B), or have slit portions in a direction of air current flow as shown in FIG. 2C.

Therefore, a conventional heat exchanger fin has one of the three above-described shapes and is thus of generally uniform shape from an upper end to a lower end thereof. That means that the heat exchanger fin exhibits a uniform heat transfer characteristic across the region between its vertical ends. However, if the velocity distribution of the air current is not uniform from one end to the other, then the rate of heat exchange between the air and fin will not be uniform. For example, if the air velocity S became gradually lower toward the bottom end of the fin, as represented in FIG. 3, for example, then the fin of FIGS. 1 and 2 would not transfer heat at a uniform rate from top to bottom. Another factor that can affect the rate of heat transfer from one end of the fin to the other is the rate of refrigerant flow through the pipes; if the flow is not uniform, then the rate of heat transfer between the pipes and the fins may vary from one end of the fin to the other.

A non-uniform heat exchange rate along the fin can reduce the overall heat exchange efficiency.

SUMMARY OF THE INVENTION

Accordingly, the present invention is directed to a heat exchanger for an air-conditioner that substantially obviates one or more of the problems due to limitations and disadvantages of the related art.

An objective of the present invention is to provide a heat exchanger fin for an air-conditioner which minimizes a deviation of a temperature distribution generated by differences in air velocity or refrigerant flow, and thus increases a heat-exchange efficiency.

To achieve these and other advantages, the present invention relates to a heat exchanger comprising a plurality of parallel fins each having first and second ends spaced apart in a first direction. The fins are spaced apart to define channels for conducting an air current in a second direction extending generally transversely relative to the first direction. Refrigerant conducting pipes pass through the fins. Each fin includes a substantially flat portion, a wavy portion, and a slit portion, arranged one after the other in the first direction.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the drawings, wherein.

DETAILED DESCRIPTION OF PREFERRED EMBODIMENTS OF THE INVENTION

Reference will now be made in detail to the preferred embodiments of the present invention, examples of which are illustrated in the accompanying drawings.

In FIGS. 3–10, the same structures as in FIGS. 1 and 2A–2C have been given the same name and numeral and a description with reference to the same structures will be omitted below.

A heat exchanger according to the invention has a plurality of parallel fins 60. According to a first embodiment, each of the fins 60 includes an upper flat portion 61, an intermediate wave portion 62, and a lower slit portion 63 arranged to correspond to an air velocity distribution which becomes gradually slower from top to bottom. Such a fin structure minimizes any non-uniformity of the heat exchange rate from a top end to a bottom end of the fin. In that regard, a flat portion exhibits the smallest resistance to air flow; a wavy portion exhibits a somewhat greater air flow resistance; a slit portion exhibits the greatest air flow resistance.

Figure 1:
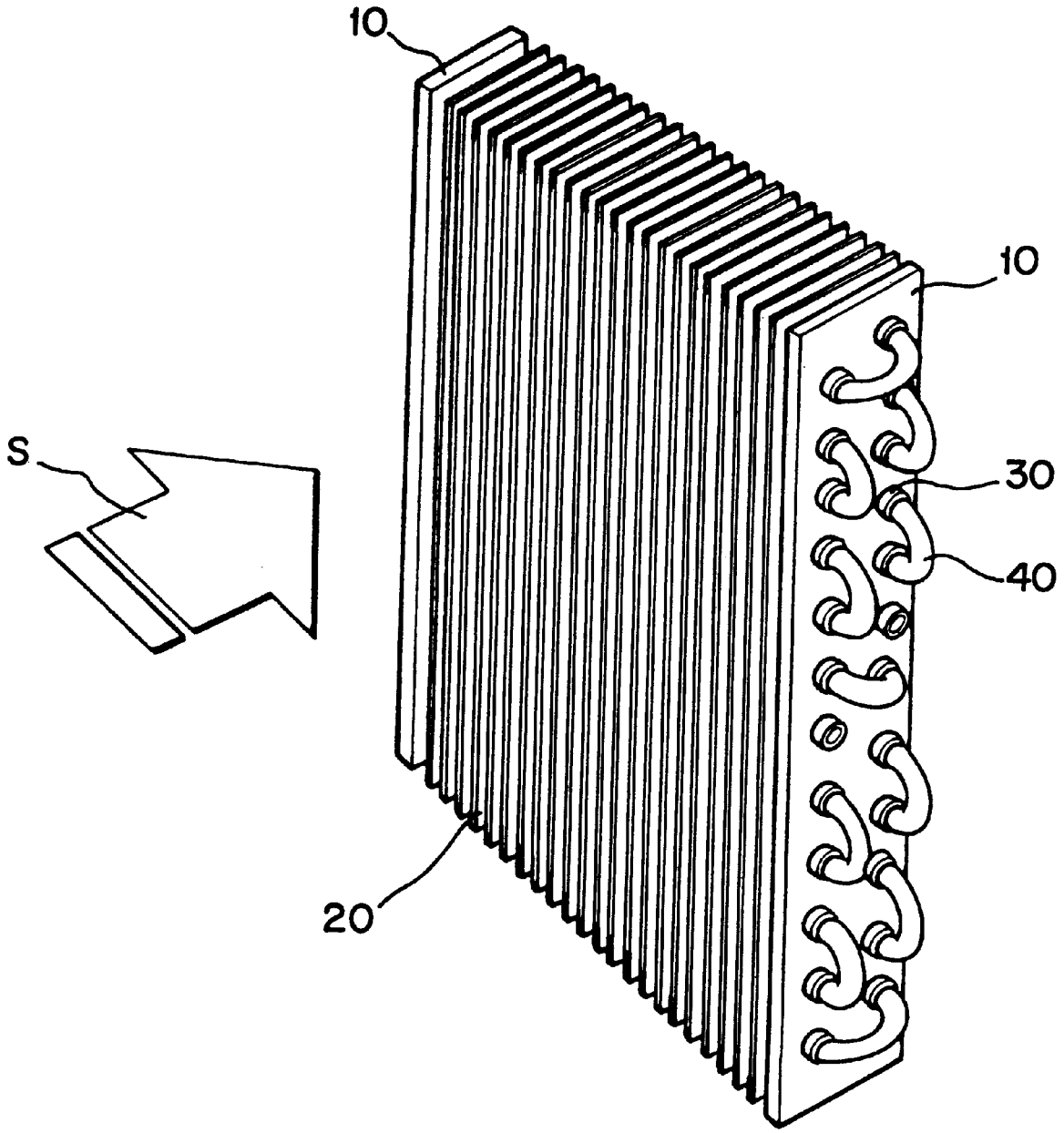
FIG. 1 (PRIOR ART)
FIG. 1 is a perspective view illustrating a conventional heat exchanger of an air-conditioner.
Figure 2A:
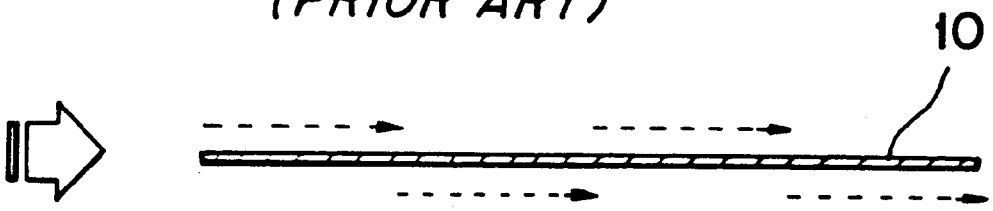
FIG. 2(A) (PRIOR ART)
FIGS. 2A, 2B and 2C are cross-sectional views illustrating conventional fins, respectively, that can be used in the FIG. 1 heat exchanger.
Figure 2B:
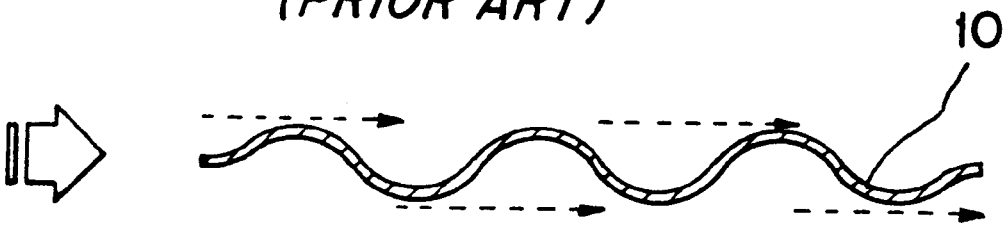
FIG. 2(B) (PRIOR ART)
Figure 2C:
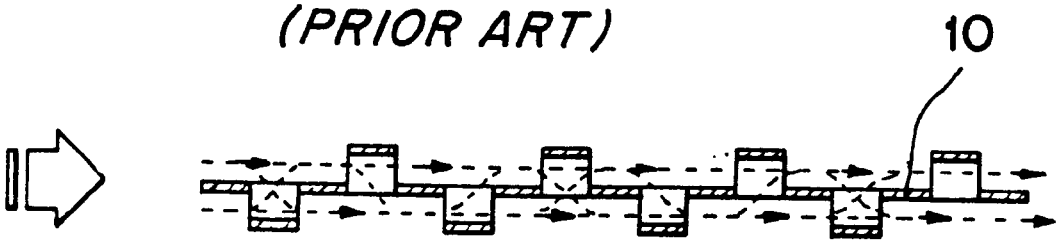
FIG. 2(C) (PRIOR ART)
Figure 3:
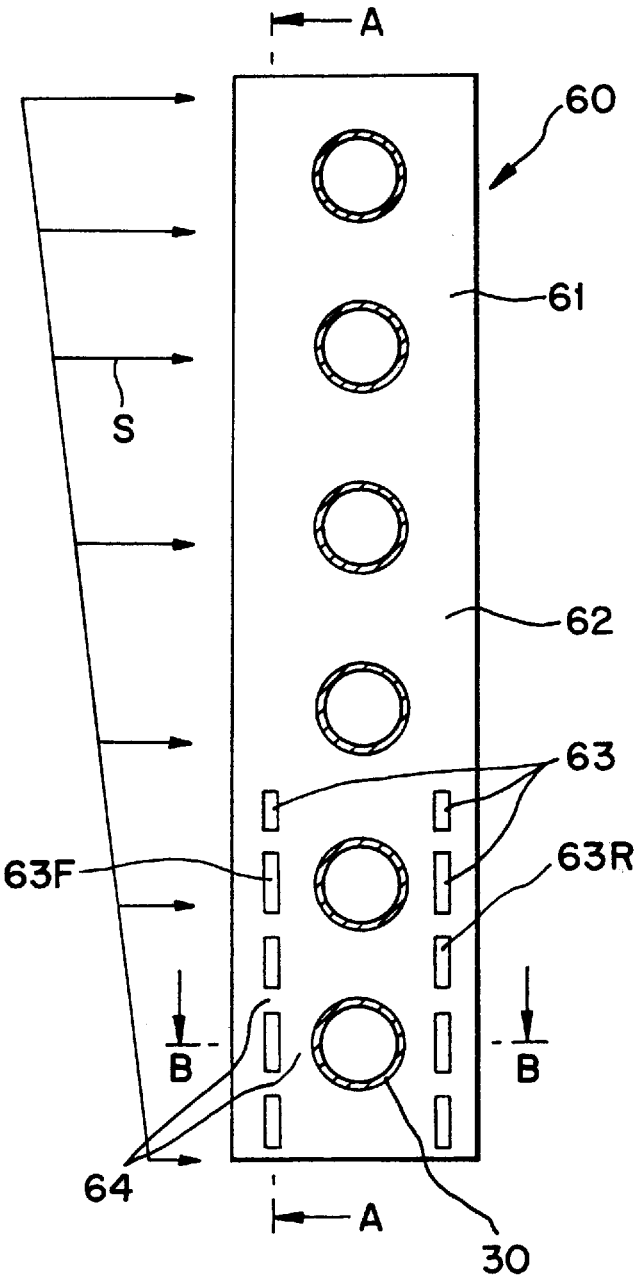
FIG. 3 is a front view illustrating a fin according to the present invention.
Figure 4:
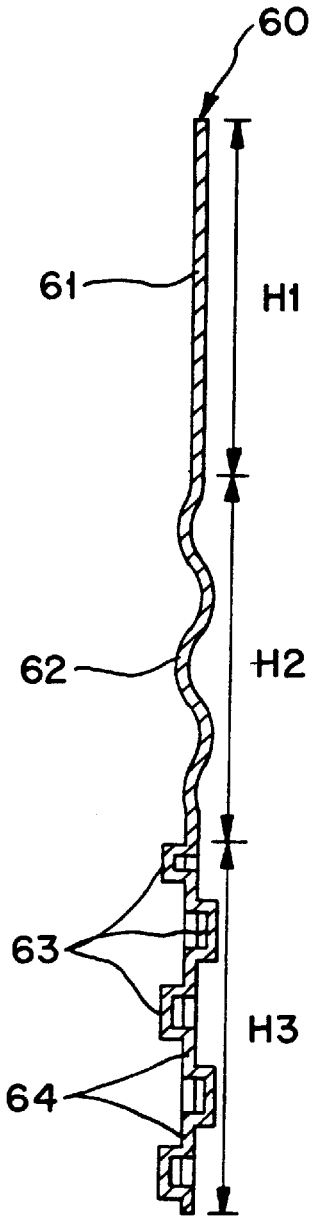
FIG. 4 is a sectional view taken on the line A—A in FIG. 3.
Figure 5:
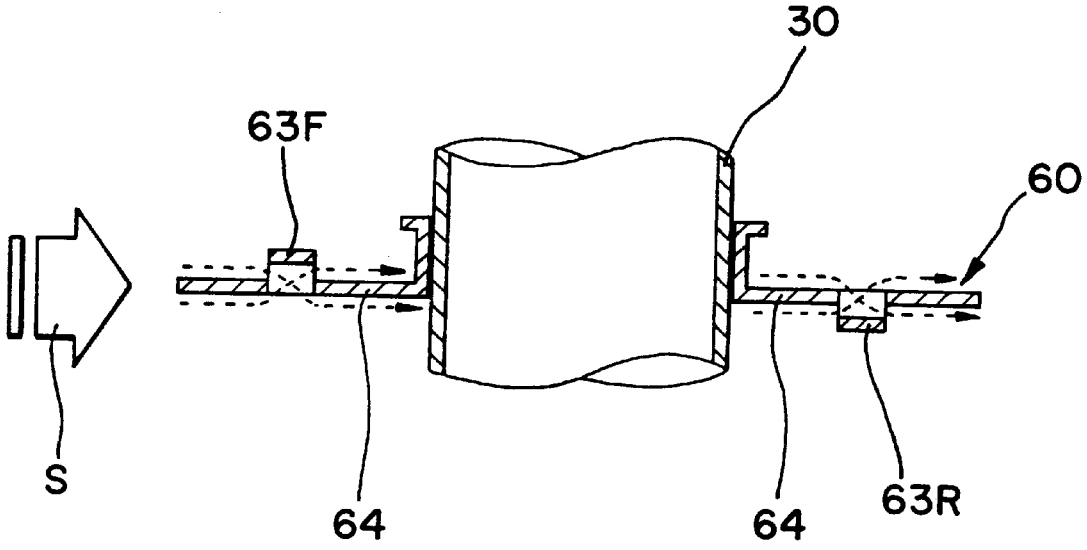
FIG. 5 is a cross-sectional view taken on the line B—B in FIG. 3.

As shown in FIGS. 3–5, the flat portion 61 occupies the upper part H1 of the fin 60, thereby corresponding to a state wherein a velocity of the air current passing through the upper part H1 of the fin 60 is larger than the velocity of the air current at an intermediate part H2 of the fin 60, and is larger than the air velocity at a lower portion H3 of the fin.

The wave portion 62 occupies the middle part of the fin 60, thereby corresponding to a state wherein the velocity of the air current passing through the middle of the fin 60 is lower than that at the upper part and greater than that at the lower part.

The slit portion 63 occupies the lower part of the fin, thereby corresponding to a state wherein the velocity of the air current passing through the lower part of the fin 60 is lower than that passing through the middle and upper parts.

As shown in FIG. 5, the slits provided in the slit portion 63 include front and rear slits 63F, 63R. The front slits 63F are arranged in front of the heat transmission plates 30 and project from a first side of the pin 60. Those slits 63F are cut out from the fin plate so as to be open toward the direction of air current. The rear slits 63R are arranged behind the heat transmission pipes 30 and project from a second side of the fin. The rear slits 63R are also open toward the direction of air current.

From FIG. 4 it can be seen that the wave portion 62 projects alternatingly at opposite sides of the fin. The same is true of the slit portion 63.

The slit portion also includes solid sections 64 extending between the slits, as well as between the slits and the pipes 30.

The operation and effects of the present invention will now be described below.

As shown in FIG. 3, when the air-current flows in an arrow direction S, the air-current passes through a plurality of the fins 60 in contact with surfaces of the fins 60 and the heat transmission pipes 30, thereby becoming hotter or colder depending upon a difference between the refrigerant temperature and the air-current temperature.

If the velocity distribution of the air-current passing through the fins 60 becomes lower as it gets closer to the lower part H3 as shown in FIG. 3, the fastest air-current passes through the upper part HI shown in FIG. 4 in contact with the flat surfaces of the flat portion 61, thereby performing a heat exchange function therewith. The intermediate speed air-current passes through the middle part H2 in contact with the wavy surfaces of the wave portion 62, thereby performing a heat exchange function therewith. The slowest air-current passes through the lower section H3 and converted to a turbulent current by the slits 63R, 63F thereby performing a heat exchange function therewith.

Thus, the flat portion 61 wherein a frictional resistance of the air-current and the rate of heat exchange are relatively low, is disposed in the high air velocity section HI. The slit portion 63, wherein a frictional resistance of the air-current and the rate of heat exchange are relatively high, is disposed in the low air velocity section H2. The wave portion 62, wherein a frictional resistance and rate of heat exchange are between that of the flat portion and slit portion, is disposed in the section H2 whose air velocity is between that of the sections HI and H3. As a result, although the velocity is different in every section, a deviation of the refrigerant's temperature distribution along the fin 60 can be lowered.

Figures 6, 7, 8, 9, 10:
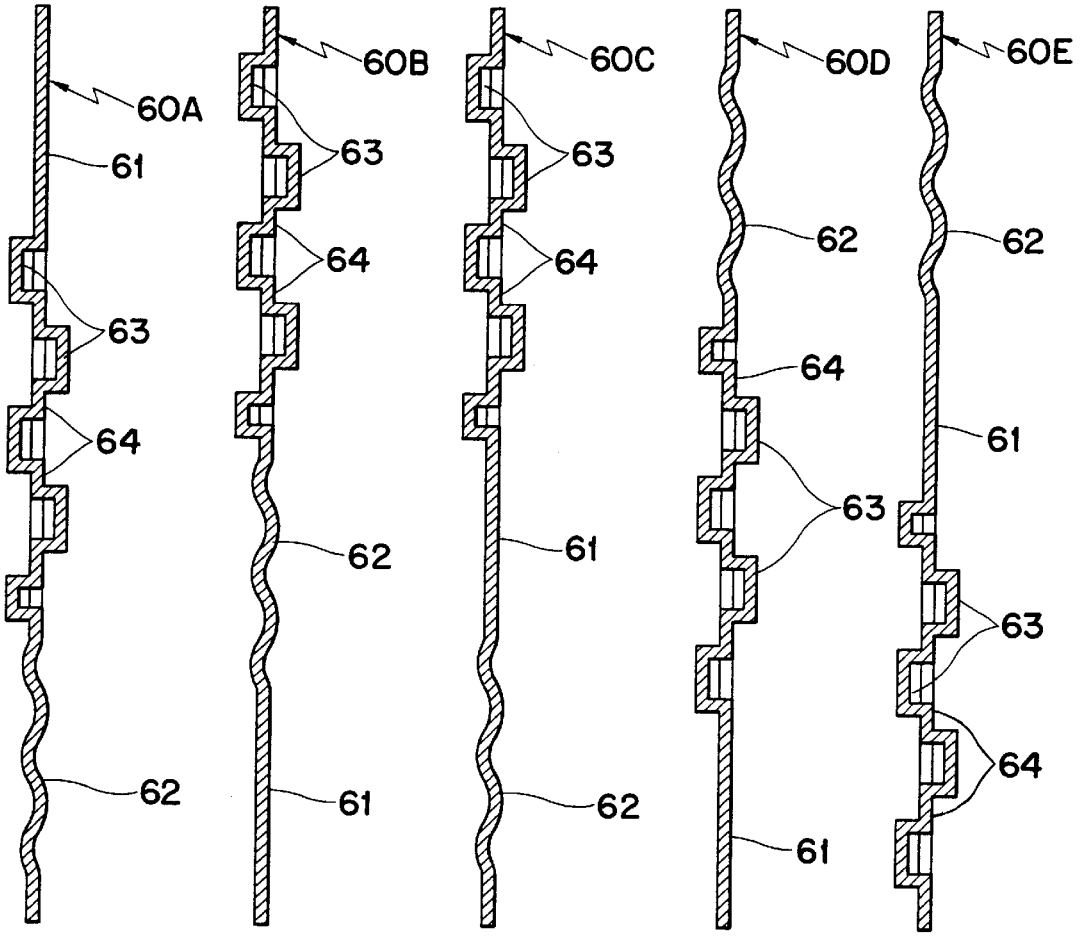
FIGS. 6 to 10 are cross-sectional views similar to FIG. 4 illustrating further embodiments, respectively, of fins according to the present invention.

The aforementioned description relates to a heat exchanger fin wherein the flat portion 61, the wave portion 62 and the slit portion 63 occupy the upper, middle and lower portions of the fin, respectively. However, it is not intended that the scope of the present invention be limited to the description as the above, because the air velocity distribution is not always of the nature depicted in FIG. 3. Therefore, as another embodiment, shown in FIG. 6, the flat portion 61, the slit portion 63, and the wave portion 62 of a fin 60A occupy the upper, middle, and lower portions of the fin, respectively. In FIG. 7, the slit portion 63, the wave portion 62, and the flat portion 61 of a fin 60B occupy the upper, middle, and lower portions of the fin, respectively.

In the embodiment shown in FIG. 8, the slit portion 63, the flat portion 61, and the wave portion 62 of a fin 60C occupy the upper, middle, and lower portions of the fin respectively.

Shown in FIG. 9 is another embodiment wherein the wave portion 62, the slit portion 63, and the flat portion 61 of a fin 60D occupy the upper, middle, and lower portions of the fin, respectively.

FIG. 10 depicts another embodiment wherein the wave portion 62, the flat portion 61, and the slit portion 63 of a fin 60E occupy the upper, middle, and lower portions of the fin, respectively.

As noted earlier, the flat portion, wave portion, and slit portion are provided to compensate for differences in air velocity. However, they can also be provided to compensate for differences in refrigerant flow within the pipes 30.

As described above, the heat exchanger fin for the air-conditioner includes a flat portion, a wave portion and a slit portion for minimizing any deviation of a temperature distribution generated in response to a difference in air velocity or a difference of a refrigerant flow, thus enhancing in efficiency of a heat exchange.

It will be apparent to those skilled in the art that various modifications and variations can be made in a heat exchanger for the air-conditioner of the present invention without departing from the spirit or scope of the invention. Thus, it is intended that the present invention cover the modifications and variations of this invention provided they come within the scope of the appended claims and their equivalents.

What is claimed is:

1. A heat exchanger comprising a plurality of parallel fins defining channels for conducting air current, each fin having first and second ends spaced apart in a first direction extending generally transversely relative to the first direction; and refrigerant conducting pipes passing through the fins; each fin including a substantially flat portion; a wavy portion, and a slit portion arranged one after the other in the first direction, the first and second ends of the fin being spaced vertically apart, wherein the flat portion is disposed above the substantially slit portion, and the substantially slit portion is disposed above the wavy portion.

2. The heat exchanger according to claim 1 wherein the wavy portion is defined by projections extending alternately from opposite sides of each fin.

3. The heat exchanger according to claim 1 wherein the slit portion includes slits protruding alternately from opposite sides of each fin.

4. A heat exchanger comprising a plurality of parallel fins defining channels for conducting air current, each fin having first and second ends spaced apart in a first direction extending generally transversely relative to the first direction; and refrigerant conducting pipes passing through the fins; each fin including a substantially flat portion; a wavy portion, and a slit portion arranged one after the other in the first direction, the first and second ends of the fin being spaced vertically apart, wherein the slit portion is disposed above the wavy portion, and the wavy portion is disposed above the substantially flat portion.

5. The heat exchanger according to claim 4 wherein the wavy portion is defined by projections extending alternately from opposite sides of each fin.

6. The heat exchanger according to claim 4 wherein the slit portion includes slits protruding alternately from opposite sides of each fin.

7. A heat exchanger comprising a plurality of parallel fins defining channels for conducting air current, each fin having first and second ends spaced apart in a first direction extending generally transversely relative to the first direction; and refrigerant conducting pipes passing through the fins; each fin including a substantially flat portion; a wavy portion, and a slit portion arranged one after the other in the first direction, the first and second ends of the fin being spaced vertically apart, wherein the slit portion is disposed above the substantially flat portion, and the substantially flat portion is disposed above the wavy portion.

8. The heat exchanger according to claim 7 wherein the wavy portion is defined by projections extending alternately from opposite sides of each fin.

9. The heat exchanger according to claim 7 wherein the slit portion includes slits protruding alternately from opposite sides of each fin.

10. A heat exchanger comprising a plurality of parallel fins defining channels for conducting air current, each fin having first and second ends spaced apart in a first direction extending generally transversely relative to the first direction; and refrigerant conducting pipes passing through the fins; each fin including a substantially flat portion; a wavy portion, and a slit portion arranged one after the other in the first direction, the first and second ends of the fin being spaced vertically apart, wherein the wavy portion is disposed above the slit portion, and the slit portion is disposed above the substantially flat portion.

11. The heat exchanger according to claim 10 wherein the wavy portion is defined by projections extending alternately from opposite sides of each fin.

12. The heat exchanger according to claim 10 wherein the slit portion includes slits protruding alternately from opposite sides of each fin.

* * * * *